United States Patent [19]

Nakada et al.

[11] 4,365,532

[45] Dec. 28, 1982

[54] ELECTRONIC MUSICAL INSTRUMENT WITH PLURAL TONE PRODUCTION CHANNELS

[75] Inventors: Akira Nakada; Takeshi Adachi, both of Hamamatsu, Japan

[73] Assignee: Nippon Gakki Seizo Kabushiki Kaisha, Hamamatsu, Japan

[21] Appl. No.: 182,464

[22] Filed: Aug. 28, 1980

[30] Foreign Application Priority Data

Sep. 3, 1979 [JP] Japan ..... 54-112580

[51] Int. Cl.[3] ..... G10H 1/06; G10H 1/38

[52] U.S. Cl. ..... 84/1.19; 84/1.17; 84/DIG. 22

[58] Field of Search ..... 84/1.01, 1.03, 1.11-1.13, 84/1.17, 1.19-1.27, DIG. 12, DIG. 22

[56] References Cited

U.S. PATENT DOCUMENTS

| | | | |
|---|---|---|---|
| 4,148,017 | 4/1979 | Tomisawa | 84/1.01 X |
| 4,192,211 | 3/1980 | Yamaga et al. | 84/1.01 |
| 4,213,366 | 7/1980 | Niimi et al. | 84/1.01 |
| 4,217,804 | 8/1980 | Yamaga et al. | 84/1.03 |
| 4,227,432 | 10/1980 | Bagus | 84/1.01 |
| 4,228,712 | 10/1980 | Uchiyama et al. | 84/1.01 |

*Primary Examiner*—S. J. Witkowski

*Attorney, Agent, or Firm*—Spensley, Horn, Jubas & Lubitz

[57] ABSTRACT

In an electronic musical instrument there are provided a channel processor which assigns tone production of a depressed key to one of musical tone producing channels which are smaller in number than total keys. The keys and channels are divided into groups respectively so that keys of one group are assigned to channels of a specific group. The relationship that which key group corresponds to which channel group is changed by an assignment mode changing circuit. Also a switch is provided for selecting a performance mode which switches the operation of the assignment mode changing circuit. Consequently, in one a performance mode all tone production channels are used solely by an upper or lower keyboard or key range while under another performance mode only some of the tone production channels are utilized for a particular keyboard or key range and the remaining tone production channels are utilized by the other keyboard or key range. Colors of musical tones produced by the tone production channels are switched according to the mode of tone production assignment.

8 Claims, 6 Drawing Figures

ELECTRONIC MUSICAL INSTRUMENT WITH PLURAL TONE PRODUCTION CHANNELS

BACKGROUND OF THE INVENTION

This invention relates to an electronic musical instrument, more particularly an improvement of an electronic musical instrument wherein tone production channel of the number smaller than that of the keys of a keyboard are provided for assigning a depressed key to either one of the tone production channels for producing a musical tone.

Recently, for the purpose of decreasing manufacturing cost by simplifying the wiring of the keyboard, by utilizing LSIs for constructing the circuit and by reducing the number of tone source circuits it has been developed an electronic musical instrument in which tone production channels of the number much smaller than the number of keys are provided so as to assign only a depressed key or keys to either one or more of the tone production channels for producing musical tones. In an electronic musical instrument provided with an upper keyboard generally used for melody performance and a lower keyboard generally used for accompaniment, usually the upper keyboard tone and the lower keyboard tone have different tone properties including tone color and amplitude envelope. For this reason, it is necessary to independently provide a plurality of tone production channels for the upper keyboard and a plurality of tone production channels for the lower keyboard. An electronic musical instrument of this type is disclosed in, for example, U.S. Pat. No. 4,192,211 issued on May 11, 1980 to Eiichi Yamaga et al. In this type of instrument, it is necessary to provide the tone production channels respectively for the upper and lower keyboards of the number sufficient to produce simultaneously a maximum number of tones, for example about 10. This is because in some cases, only the upper keyboard must be performed with both hands, or only the lower keyboard must be performed with both hands. However in a normal mode of performance utilizing both upper and lower keyboards, a melody performance is performed by utilizing the upper keyboard with one hand (right hand) and an accompaniment performance is performed by utilizing the lower keyboard with the other hand (left hand). In this case, the number of the actually used tone production channels (about 1 to 3 channels) for respective upper and lower keyboards is much smaller than the total number of the tone production channels leaving many channels idle.

SUMMARY OF THE INVENTION

Accordingly, it is an object of this invention to provide an improved electronic musical instrument capable of effectively using a limited number of tone production channels as melody channels and accompaniment channels according to the mode of performance.

Another object of this invention is to provide an improved electronic musical instrument capable of modifying the mode of use of the tone production channels in accordance with the operation of a switch.

Still another object of this invention is to provide a novel electronic musical instrument which can be manufactured at a lower cost than that provided with the same number of tone production channels.

To accomplish these objects, according to this invention, the relationship between the tone production channels and the keyboard (or key range) is not fixed but instead the relationship is changed in accordance with the mode of performance. An assignment mode modifying means is added to a channel processor for assigning the tone of a depressed key to one of tone production channels of a specific number so as to change the relationship between the tone production channels and the keyboards (or key range). A suitable switch circuit for selecting the performance mode is provided to produce an information that designates the mode of performance so as to switch the operation of the assignment mode modifying means. As a consequence, the tone production assignment mode is modified such that for a given performance mode all tone production channels are used only by a specific keyboard (or key range), whereas for a different performance mode only a portion of the tone production channels is used for the specific keyboard (or key range) and the rest of the channels is used for another keyboard or key range. The tone color and/or tone amplitude envelope of a musical tone produced by each tone production channel may be switched in accordance with the modification of the tone producing assignment mode.

Briefly stated, according to this invention there is provided an electronic musical instrument comprising keyboard means provided with a plurality of keys; musical tone generating means including a plurality of musical tone production channels of a number smaller than that of a total number of the keys; assigning means for assigning a tone production corresponding to a depressed key of a key group comprising certain keys of said plurality of keys to one of the musical tone production channels; means for selecting a performance mode of the electronic musical instrument from among a plurality of performance modes and for dividing the musical tone production channels into a plurality of groups in accordance with the set performance mode; and assignment mode changing means for changing musical tone production channels belonging to a channel group to which the key in the key group are assigned in accordance with an output of the performance selecting means, the assigning means assigning tone production of the depressed key of said key group to one of the musical tone production channels of said channel group determined by the assignment mode changing means, and the musical tone producing means acting to make different manners of tone production among respective channel groups according to the output of the performance mode selecting means.

DESCRIPTION OF THE PREFERRED EMBODIMENT

Figure 1:
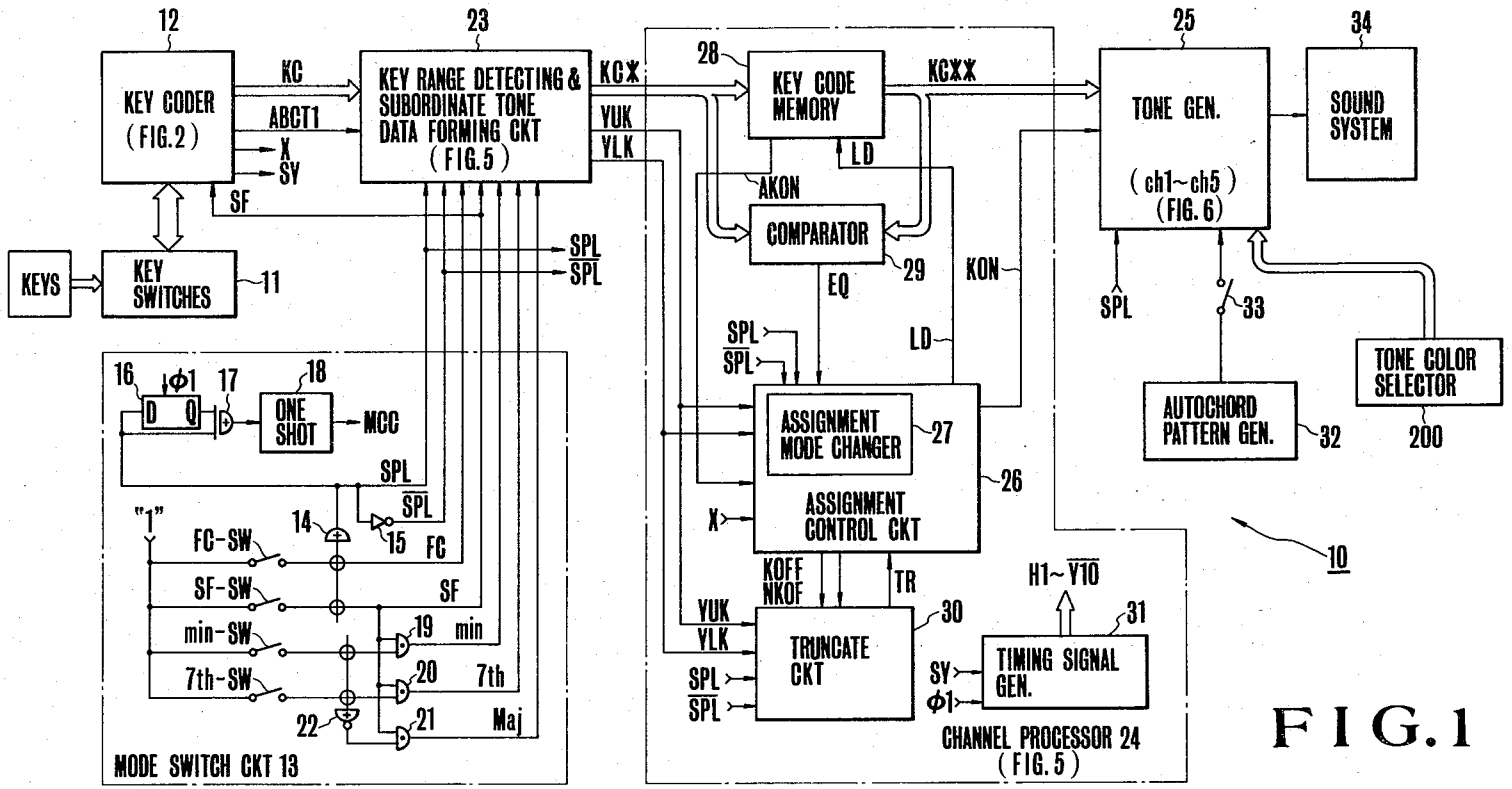
FIG. 1 is a block diagram showing the general construction of one embodiment of the electronic musical instrument according to this invention.

The electronic musical instrument 10 shown in FIG. 1 is of the single stage keyboard type and comprises a key switch circuit 11 in which a plurality of key switches are arrayed corresponding to respective keys of a keyboard. There is also provided a key coder 12 which detects the ON/OFF states of the respective keys of the key switch circuit 11 for producing a key code KC representing a closed key switch or a depressed key. The key coder 12 produces a key off examination signal X utilized to detect a released key, and a synchronizing pulse SY synchronous with the sending out timing of the key code KC.

A mode switch circuit 13 includes a switch for selecting and setting a performance mode. The utilization mode of the tone production channels comprises two modes, one utilizing all tone production channels in common for all keys so as to cause all keys of the keyboard to produce tones of the same tone color, for example, a melody type tone color (for convenience it is called a common mode $\overline{SPL}$), and the other utilizing the tone production channels by dividing them into two groups and by dividing the keyboard into two key ranges so as to cause the divided key ranges to produce tones of different colors. For example, the high tone side key range is used to produce a tone color of the melody type, while the low tone side key range is used to produce a tone color of the accompaniment type. For brevity this mode is called a split mode (SPL). In this embodiment, a selection switch for the two utilization modes (SPL and $\overline{SPL}$) is not directly provided but instead the circuit is constructed such that the two production channel utilization modes (SPL, $\overline{SPL}$) are automatically set in accordance with the performance function selected by a performance function selection switch. More particularly, upon selection of an automatic bass chord performance (ABC) a split mode SPL is set, while a common mode $\overline{SPL}$ is selected when the automatic bass performance is not selected.

A mode switch circuit 13 is provided with a selection switch FC-SW for selecting a finger chord function, one of the functions of the automatic bass chord performance, and a selection switch SF-SW for selecting a single finger function. When the finger chord function selection switch FC-SW is closed, a finger chord function selection signal FC for the automatic bass chord performance is generated. Under this state, in the electronic musical instrument 10, a key in a predetermined low tone side key range is depressed to produce a tone with an accompaniment color, while a key in a predetermined high tone side key range is depressed to produce a tone with a melody tone color. As the single finger function selection switch SF-SW is closed, a single finger function selection switch SF is closed. Under this state, in the electronic musical instrument, a key in the low tone side key range is depressed to automatically produce a root tone together with a subordinate tone (a tone having a predetermined tone interval relationship) which are produced with an accompaniment tone color, while a key in the predetermined high tone side key range is depressed to produce a tone with a melody tone color. Where both switches FS-SW and SF-SW are off the automatic bass chord performance would not be selected but all keys of the keyboard produce tones of the same color, i.e., the melody tone color. Since the circuit concerning the bass tone has no relation with the present invention, it is not shown in FIG. 1.

The outputs of the switches FC-SW and SF-SW are inputted to an OR gate circuit 14. The output there of is utilized as a signal SPL indicative of the split mode and is inverted by an inverter 15 to form a signal $\overline{SPL}$ indicative of the common mode. The output of the OR gate circuit 14 is also inputted to a delay flip-flop circuit 16 and one input of an exclusive OR gate circuit 17, the output of the delay flip-flop circuit 16 being applied to the other input of the EXCLUSIVE-OR gate circuit 17. As the output of the OR gate circuit 16 changes from "1" to "0" or vice versa, that is as the tone production channel utilization mode changes from SPL to $\overline{SPL}$ or vice versa, the output of the exclusive OR gate circuit 17 temporary becomes "1" (for one period of a clock pulse $\phi$1). The output of the EXCLUSIVE-OR gate circuit 17 is applied to a one shot circuit 18 which produces a pulse having a larger width, in this example 10 microseconds. The output of the one shot circuit 18 is used as a clear signal MCC at the time of mode switching.

Switches min-SW and 7th-SW are used to select the type of the chords at the time of single finger function. The output of the minor selection switch min-SW is applied to one input of an AND gate circuit 19 and an NOR gate circuit 22, whereas the output of the seventh selection switch 7th-SW is applied to the other input of the AND gate circuit 20 and the NOR gate circuit 22. The output of the NOR gate circuit 22 is "1" and inputted to one input of an AND gate circuit 21 when the chord type is neither minor nor seventh, i.e., major. To the other inputs of the AND gate circuits 19–21 is applied the output of the single finger function selection switch SF-SW. AND gate circuit 19–21 produce a minor signal min, a seventh signal 7th and a major signal Maj, respectively.

The signals SPL–Maj outputted from the mode switch circuit 13 are applied to the key range detecting and subordinate data forming circuit 23. The single finger function selection signal SF is also applied to the key coder 12 to cause it to produce a timing signal ABCT1 designating an interval for forming a subordinate data. Signals $\overline{SPL}$ and SPL representing the tone production channel utilization modes are also applied to a tone production assignment means, that is the channel processor 24 to change the mode of tone production assignment.

A key code KC generated by the key coder 12 and representing the depressed key is supplied to the channel processor 24 via the key range detecting and subordinate tone data forming circuit 23 which, in accordance with the states of the mode signals SPL and $\overline{SPL}$ detects whether the key code KC belongs to the low key range or the high key range in the case of the split mode SPL. Where the key code KC belongs to the high key range, a high key range signal YUK (key group signal) is produced whereas when the key code KC belongs to the low key range a low key range signal YLK (key group signal) is produced. Further, in the case of the common mode $\overline{SPL}$ a high key range signal YUK is generated regardless of the key ranges. In the case of the single finger function SF, the circuit 23 automatically forms a subordinate key code based on the key code corresponding to the root note and signals min, 7th and Maj representing the types of the chords. A key code KC* (a key code KC from the key coder 12 or an automatically formed key code) produced by the key range detecting subordinate tone forming circuit 23 is supplied to the channel processor 24.

A tone generator 25 is provided with five tone production channels ch1 through ch5 and the channel processor 24 assigns the key code KC* to either one of these tone production channels. The channel processor 24 is provided with a assignment mode changer 27 in addition to an assignment control circuit 26. The assignment mode changer 27 operates to utilize all tone production channels ch1–ch5 by all keys of the keyboard under the common mode SPL, whereas under the split mode SPL, the mode of assignment is changed such that a predetermined channels (ch1 and ch2) are used by the keys in the high key range (melody tone color) and that the remaining channels (ch3, ch4 and ch5) are utilized by the keys in the low key range (accompaniment tone color).

The key code memory device 28 in the channel processor 24 has five memory areas corresponding to the five tone production channels ch1–ch5 respectively so that key codes assigned to respective channels are stored in corresponding memory areas. A comparator 29 compares the key code KC* supplied from the key range selecting and subordinate tone forming circuit 23 and an already assigned key code KC stored in the key code memory device 28 to produce a coincidence signal EQ when both inputs coincide with each other. The assignment control circuit 26 assigns the key code KC to either one of the channels in a channel group ch1–ch5 or ch1–ch2 or ch3–ch5, designated by the assignment mode changer 27 provided that the key code KC from the circuit 23** has not yet been assigned to any channel. More particularly, a load signal LD is produced corresponding to a channel to be assigned with the key code KC*. The assignment control circuit 26 produces a key-on signal KON representing whether keys assigned to respective channels are now being depressed or not. A truncate circuit 30 is provided to detect a channel assigned with a key code corresponding to an earliest released key and to produce a truncate channel designation signal TR corresponding to a detected channel (a channel to be truncated). A timing signal generator 31 produces timing signals for controlling the operation of the circuits in the channel processor 24 in accordance with a synchronizing pulse SY supplied from the key coder 12.

The tone generator 25 produces a musical tone signal based on the key codes KC assigned to respective channels (ch1–ch5) and corresponding key-on signals KON. A signal SPL representing the split mode is applied to the tone generator 25. At the time of the split mode, the tone colors of the channels ch1–ch2 and ch3–ch5 are made to be different by the manual operation of a tone color selector 200. An autochord pattern generator 32 generates a pattern pulse representing the tone producing timing of the autochord. To produce an automatically interrupted chord, a autochord selection switch 33 is closed to apply a pattern pulse from the pattern generator 32 to the tone generator 25 to automatically control the low key range tone (tone of the accompaniment tone color) assigned to the channels ch3–ch5. The musical tone signal generated by the tone generator 25** is applied to a sound system to be converted into a musical tone.

Having completed the general description of various circuit elements, the detail of each element will be described hereunder.

Figure 2:
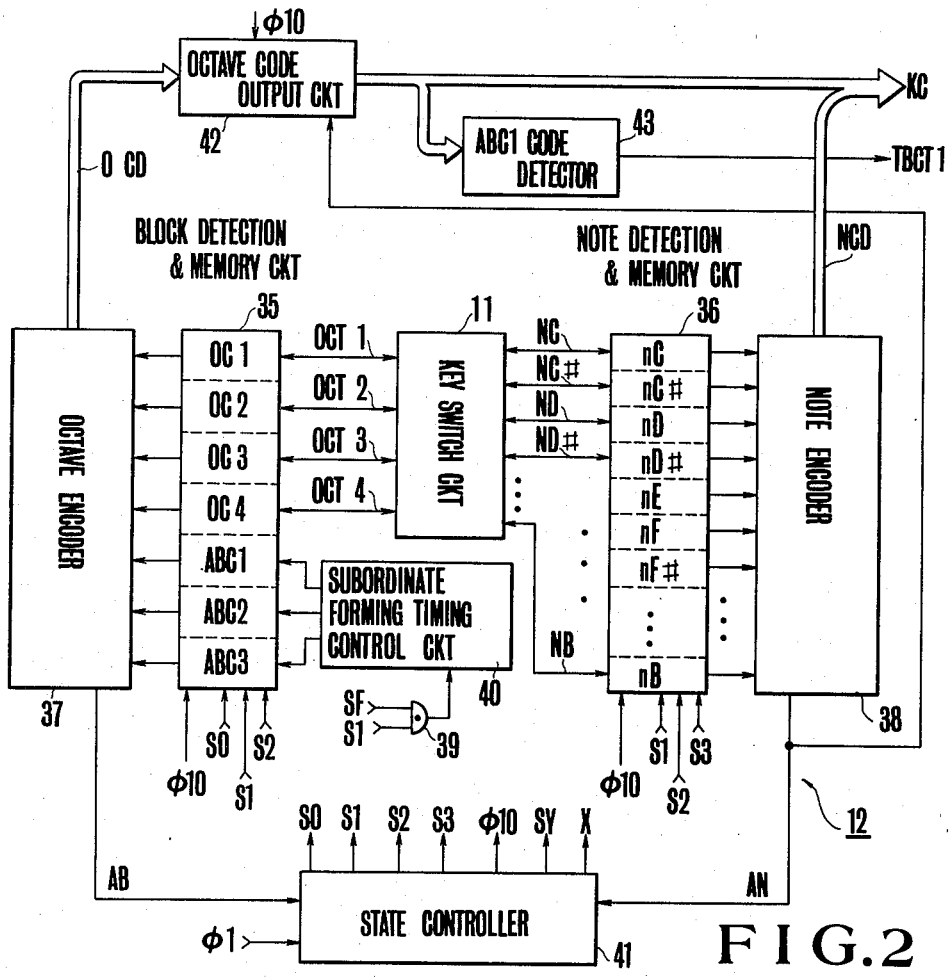
FIG. 2 is a block diagram showing one example of the key coder shown in FIG. 1.

FIG. 2 is a block diagram showing the detail of one example of the key coder 12 which is constructed to efficiently detect only a closed key switch by parallelly transmitting and receiving signals via octave wirings OCT1, OCT2, OCT3, and OCT4 and note wirings NC–NB of the key switch circuit 11 which are arrayed in the form of a matrix and constructed according to the well known key coder technique disclosed, for example, in U.S. Pat. No. 4,148,017 issued on Apr. 3, 1979 to Norio Tomisawa of the title "Device for Detecting a Key Switch Operation" or a key code generator disclosed, for example in a copending U.S. Patent Application Ser. No. 940,381 filed on Sept. 7, 1978 by Yasuji Uchiyama et al of the title "Key Code Data Generator" now U.S. Pat. No. 4,228,712 assigned to Nippon Gakki Co., Ltd., the same assignee as the present case. The octave wirings OCT1–OCT4 of the key switch circuit 11 corresponds to the first to the fourth octaves respectively and are respectively connected to portions OC1–OC4 corresponding to the first to the fourth octaves of the block detection and memory circuit 35. The note wirings NC–NB of the key switch circuit 11 respectively correspond to 12 notes of C, C♯, D–B and are respectively connected to portions nC–nB corresponding to respective notes C–B.

The circuit portions OC1, OC2, OC3, OC4, ABC1, ABC2, ABC3 and nC–nB of the block detecting and memory circuit 35 and the note detecting and memory circuit 36 have functions to store data respectively applied thereto. Furthermore, the circuit portions OC1, OC2, OC3, OC4, nC–nB function to send data "1" to the key switch circuit 11 through the octave wirings OCT1–OCT4 or the note wirings NC–NB. The block detecting and memory circuit 35 as a whole has a function of preferentially select and produce the data stored in the circuit portions OC1, OC2, OC3, OC4, ABC1, ABC2 and ABC3 in the order mentioned. In the same manner, the note detecting and memory circuit 36 as a whole functions to preferentially select and produce data stored in the circuit portions nC, nC♯, nD–nB in the order mentioned. At this time the memory from which the data has been preferentially selected and outputted is cleared so as to selectively select and output starting from the upper order data.

The data of the block detecting and memory circuit 35 preferentially selected and outputted are sent to an octave encoder 37. The data of the note detecting and memory circuit preferentially selected and outputted are applied to a note encoder 38 which encodes the data supplied from the circuit portions nC–nB corresponding to respective note C–B as shown in the following code thus producing the note codes NCD.

TABLE I (Note code table)

| Note | NCD | Note | NCD |
|---|---|---|---|
| D | 0001 | F♯ | 1001 |
| C♯ | 0010 | G | 1010 |
| D | 0011 | G♯ | 1011 |
| D♯ | 0101 | A | 1101 |
| E | 0110 | A♯ | 1110 |
| F | 0111 | B | 1111 |

The octave encloder 37 encodes the data inputted from the circuit portions OC1–OC4, ABC1–ABC3 as shown in the following Table II to produce octave codes OCD.

TABLE II

| Input | (Octave code table) OCD | Input | OCD |
|---|---|---|---|
| OC1(first) | 001 | ABC1 | 101 |
| OC2(second) | 010 | ABC2 | 110 |
| OC3(third) | 011 | ABC3 | 111 |
| OC4(fourth) | 100 | | |

The purpose of the circuit portions ABC2, ABC2 and ABC3 of the block detecting and memory circuit 35 is to set a timing for forming subordinate tone data in the key range detecting and subordinate tone data forming circuit 23 at the time of the single finger function. When an AND gate circuit 39 is enabled by the application of the single finger function selection signal SF and the state control signal S1 the subordinate tone forming timing control circuit 40 causes the circuit portions ABC1, ABC2 and ABC3 to store data "1" respectively.

Figure 3:
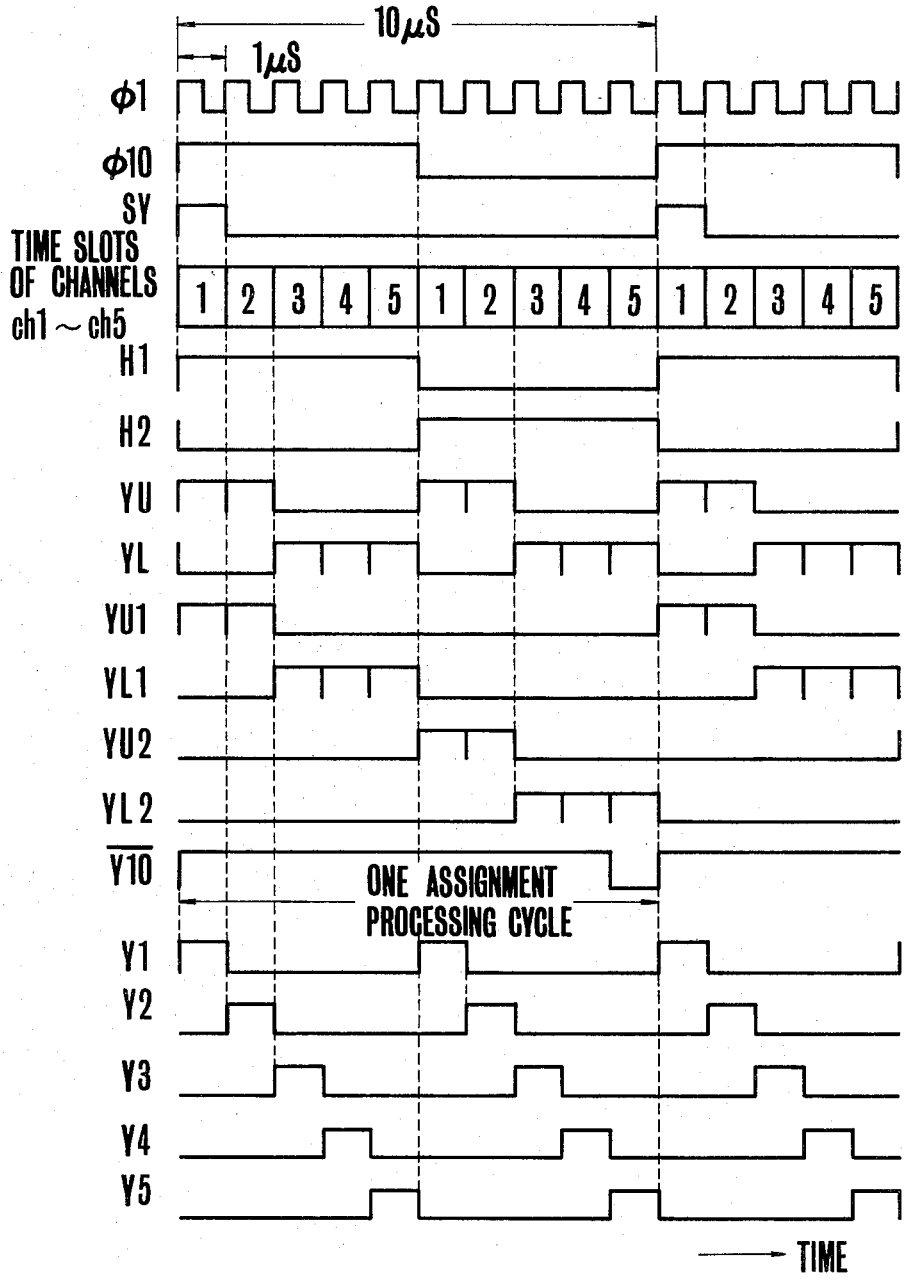
FIG. 3 is a timing chart showing the time relationship among a clock pulse and various other timing signals.

When any data "1" is being stored in the block detecting memory circuit 35, an any block signal AB is generated. In the same manner, when any data "1" is being stored in the note detecting memory circuit 36, an any note signal AN is produced, and these signals are applied to a state controller 41 which in response to these signals generates state control signals S0, S1, S2 and S3 that control the operation of the key coder 12 and also generate a clock pulse $\phi$10 and the synchronizing puse SY based on the clock pulse $\phi$1. The state control circuit 41 also generates periodically and repeatedly a key-off examination signal X. As shown in FIG. 3, the clock pulse $\phi$1 has a period of 1 microsecond, whereas the clock pulse $\phi$10 has a period of 10 microseconds obtained by dividing the clock pulse $\phi$1 by 10. The synchronizing pulse SY is generated in synchronism with the build-up of the clock pulse $\phi$10 and having a width of 1 microsecond and a period of 10 microsecond. The state control signals S0, S1 and S2 are applied to the block detecting and memory circuit 35, while the state control signals S1, S2 and S3 are supplied to the note detecting and memory circuit 36.

In the state control circuit 41, the state control signals S0–S3 are generated according to the following flow chart. The state control signal S0 represents a waiting state, and as this signal S0 is generated the all contents of the block detecting memory circuit 35 are cleared. The key-off examination signal X is generated at an interval of 5 ms only when the signal S0 is being generated. The key-off examination signal X has a pulse width of 10 microseconds. The clock pulse utilized for the block detecting memory circuit 35 and the note detecting memory circuit is a clock pulse $\phi$10 having a period of 10 microseconds and each one of the state control signals S0–S3 is generated at an interval of 10 microseconds.

The signal S1 is generated next to the state control signal S0. Upon generation of the state control signal S1, the note detecting memory circuit 36 gives a signal "1" to the key switch circuit 11 through note wirings NC–NB to produce a signal "1" on one or a plurality of octave wirings OCT1–OCT4 through the closed key switches of the key circuit 11 and the signals "1" is stored in the corresponding circuit portions OC1–OC4 of the block detecting and memory circuit 35. At the same time the contents of respective circuit portions nC–nB of the note detecting and memory circuit 36 are cleared. Where the single finger function is selected, the subordinate tone forming timing circuit 40 applies "1" signal to respective circuit portions ABC1–ABC3 to be stored therein. As above described, upon generation of the state control signal S1, signal "1" is stored in the circuit portions OC1–OC4 corresponding to the octaves to which the closed key switch belongs, thus detecting all octaves including the closed key switch, i.e., a depressed key. Where at least one key is depressed, the any block signal AB becomes "1".

After generation of the state control signal S1, the state control circuit 41 judges whether the any block signal AB is "1" or not, and when the result of judgement is YES (AB="1") the state control signal S2 is generated whereas when the result of judgement is NO (AB="0") the state control signal S0 is generated.

Upon generation of the state control signal S2, the block detecting and memory circuit 35 preferentially selects data "1" out of one of the circuit portions OC-1–OC4, ABC1–ABC3 respectively storing data "1". The preferentially selected data is applied to the octave encoder 37 to form an octave code OCD (Table 2) corresponding to the selected data. This octave code OCD is temporarily stored in an octave code output circuit 42. Further, the preferentially selected data is supplied to the key switch circuit 11 through either one of the octave wirings OCT1–OCT4 to produce data "1" on either one or a plurality of note wirings NC–NB corresponding to the closed key switches belonging to that octave. In the note detecting memory circuit 36, the data "1" supplied through the note wirings NC–NB is stored in corresponding circuit portions nC–nB. In the block detecting and memory circuit 35 the content of the circuit portion (either one of OC1–OC3 and ABC1–ABC3) which has been preferentially selected is cleared.

After generating the state control signal S2 the state control circuit 41 judges whether the any note signal AN is "1" or not. If any one of circuit portions OC-1–OC4 corresponding to the octave were preferentially selected in the block detecting and memory circuit at the appearance of the step control signal S2, data "1" would be stored in the note detecting and memory circuit 36 so that the any note signal AN is "1". When the fact that the any note signal AN is "1" is confirmed the state control signal S3 is generated.

Upon generation of this signal, the note detecting memory circuit 36 preferentially selects "1" from one of the circuit portions nC–nB that are storing data "1". The data thus preferentially selected is inputted to a note encoder 28 to form a note code (see Table I) corresponding to that data. When the note code NCD is produced the octave code that has been stored in the octave code output circuit 42 is also outputted at the same time. By the combination of these note code NCD and the octave code OLD a key code KC is formed. The time width of sending out one key code KC is the same as that of clock pulse $\phi$10 that is 10 microseconds. The octave code output circuit 42 is constructed to produce an octave code OCD in synchronism with the note code NCD when the any note code AN is "1", whereas when the any note code AN is "0" produce the code OCD of the circuit portions ABC1–ABC3 only when the code OCD represents the contents of these circuit portions, and the memory of the note preferentially selected by the note detecting and memory circuit 36 is cleared.

After generating the state control signal a judgement is made again as to whether the any note signal AN is "1" or not. When another note memory of the closed key switch is still remaining in the note detecting memory circuit 36 the any note signal becomes "1" and the state control signal S3 is generated again. In the same manner as above described remaining note memories are preferentially selected to produce the note code NCD and octave code OCD. In this manner a key code KC of a different depressed key is produced at an interval of 10 microseconds. Thereafter, the state control signal S3 is repeatedly generated to successively produce the key code of the depressed key until the note memory becomes zero, that is the any note signal AN becomes "0".

When the any note signal AN becomes "0" a judgement is made again as to whether AB is "1" or not. So long as a circuit portion storing data "1" still retained in the block detecting memory circuit 35, signal AB is "1" thus generating the state control signal S2 in the same manner as above described. When data "1" is preferentially selected from the circuit portions OC1–OC4 corresponding to the octave at the time of generation of the state control signal S2, its octave code OCD is temporarily stored in the octave code output circuit 42 in the same manner as above described, and thereafter the note code NCD and the octave code OCD, that is a key code KC of the depressed key at the time of generation of the state control signal. Upon completion of the sequential generation of the key code KC of the depressed key all memories in the circuit portion corresponding to the octave of the block detecting and memory circuit 35 are cleared. Where the single finger function is selected, circuit portions ABC1–ABC3 at lower orders still stores "1" so that the any block signal AB is "1". Accordingly, the state control signal S2 is generated and a code indicative of the circuit portion ABC1 would firstly be produced from the octave encoder 37. At this time, however, since signal "1" is not applied to the key switch circuit 11 from the circuit portions OC1–OC4 via wirings OCT1–OCT4 all memories of the note detecting memory circuit 36 are "0" so that any note signal AN is also zero. Accordingly, the state control signal S3 would not be generated and a judgement is made again as to whether AB is "1" or not so that codes OCD of circuit portions ABC1, ABC2 and ABC3 are generated successively.

In the octave output circuit 42, since the any note signal AN is "0" the codes OCD of the circuit portions ABC1, ABC2 and ABC3 are passed without any processing. An ABC1 code detector 43 detects the code (i.e., "101" as shown in Table II) of the leading code AB1 among ABC1–ABC3 so as to produce a subordinate tone forming timing signal ABCT1 having a width of 10 microseconds by the timing action of this code ABC1. During an interval of 30 microseconds subsequent to the build-up of this subordinate tone forming timing signal ABCT1, that is while the codes OCD of ABC1, ABC2 and ABC3 are being produced by the encoder 37, no key code KC would be produced.

When the code of the least significant order ABC is sent out all memories of the block detecting memory circuit 35 are cleared and the any block signal AB becomes "0". Then the state control circuit 41 returns to the waiting state to generate a state control signal S0.

Figure 4:
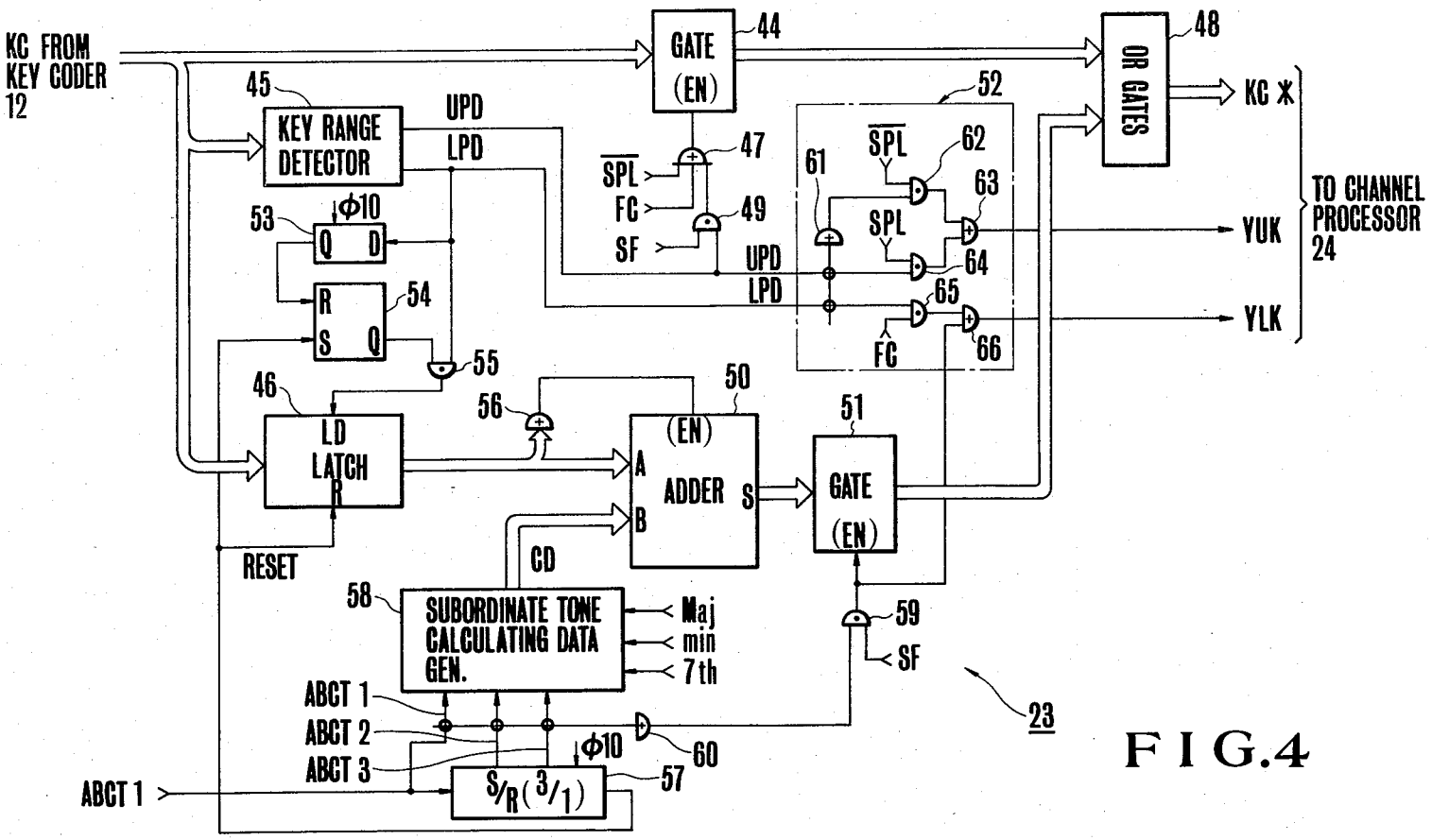
FIG. 4 is a block diagram showing one example of the key range detecting and subordinate tone forming circuit shown in FIG. 1.

FIG. 4 is a block diagram showing one example of the key range detecting and subordinate tone data forming circuit 23. The key code KC of a depressed key sequentially outputted from the key coder 12 shown in FIG. 2 at an interval of 10 microseconds is applied to a gate circuit 44, a key range detecting circuit 45 and a latch circuit 46 shown in FIG. 4.

Under the common mode $\overline{SPL}$ the signal $\overline{SPL}$ is "1" and is normally applied to the enabling input EN of the gate circuit 44 through an OR gate circuit 47 so that all key codes KC pass through the gate circuit 44 and applied to the channel processor 24 through group of OR gate circuits 48 as the key code KC*.

Under the split mode SPL, the control mode of the gate circuit 44 becomes different depending upon whether the finger code function FC or the single finger function SF is selected. When the finger code function FS is selected the finger code function selection signal FC is "1" so that signal "1" is normally applied to the enabling input EN of the gate circuit 44 via OR gate circuit 47 so that all key codes KC pass through the gate circuit 44 and then applied to the key processor via the OR gate circuit group 48. This means that, in the case of the finger code function FC, only a key actually being depressed of the keyboard is the object of the assignment processing of the channel processor 24. Where the single finger function SF is selected only a key code KC in the high key range to be produced with a melody tone color passes through the gate circuit 44 whereas the key code in the low key range is blocked by the gate circuit 44. More particularly, the single finger function selection signal SF and the high key range detection signal UPD are inputted to an AND gate circuit 49, and the output thereof is applied to the enabling input EN of the gate circuit 44 via OR gate circuit 47. In the case of the single finger function SF the key code KC representing a depressed key in the low key range is blocked by the gate circuit 44, whereas a key code from a computation circuit or an adder 50 is applied to the channel processor 24 as the key code KC* passes through a gate circuit 51 and the OR gate circuit group 48.

A key range detecting circuit 45 judges whether a depressed key corresponding to a key code belongs to the high key range or a low key range according to the content of an octave key code OCD contained in the key code KC. The key range is divided into a low key range comprising the first octave OC1 and the second octave OC2, and a high key range comprising the third octave OC3 and the fourth octave OC4. As a consequence, the key range detecting circuit 45, produces a low key range detection signal LPD when the octave code OCD of the input key code KC is "001" or "010", whereas produces a high key range detection signal UPD when the octave code OCD is "011" or "100". The low key range detection signal LPD or the high key range detection signal UPD is inputted to a key range signal generator 52.

A latch circuit 46 is provided to latch a key code corresponding to a root tone utilized to form a subordinate key code at the time of the single function. In connection with the latch circuit 46, a delay flip-flop circuit 53, a set-reset type flip-flop circuit 55 and an AND gate circuit 55 are provided for the purpose of latching a key code of the lowest tone of a depressed key in the low key range. In the key coder 12 shown in FIG. 2, the order of priority for detecting the depressed key is set to the low tone priority (in the block detecting memory circuti 35, the first octave OC1 has the highest order of priority and in the note detecting memory circuit 16 note C has the highest order of priority) so that a depressed key on the low tone side firstly produces a key code KC. When a key code KC of the depressed key of the least significant order in the low key range is supplied to the circuit 23 shown in FIG. 4, the key range detecting circuit 45 produces a low key range detection signal LPD. This first low key range detection signal LPD is applied to one input of an AND gate circuit 55. After being delayed by 10 microseconds by the delay flip-flop circuit 53, the low key range detection signal LPD is applied to the reset input R of the flip-flop circuit 54. At first this flip-flop circuit 54 is at the set state and its set output Q is applied to the other input of the AND gate circuit 55. Accordingly, in response to the low key range detection signal, that is the depressed key at the least significant order, the output of the AND gate circuit 55 becomes "1" which is applied to the load control input LD of the latch circuit 46. As a consequence, the key code KC of the depressed key of the least significant order applied to the data input of the latch circuit 46 would be latched. Thereafter, since the flip-flop circuit 54 is reset, the AND gate circuit 55 is disenabled to hold the key code of the depressed key at the least significant order latched by the latch circuit 46, that is the root tone.

The key code of the root tone latched by the latch circuit 46 is applied to the A input of the computation circuit 50 and to an OR gate circuit 56. As long as a key code corresponding to the root tone is being latched in the latch circuit 46 the output of the OR gate circuit 56 becomes "1" and applied to the enabling input EN of the computating circuit which is operable only when signal "1" is inputted to its enabling terminal EN.

The subordinate tone forming timing signal ABCT1 outputted from the key coder 12 shown in FIG. 2 is applied to a 3 stage/1 bit shift register 57 and a subordinate tone calculating data generator 58. The shift register 57 is driven by the clock pulse $\phi$10 and its first stage output is applied to the subordinate tone calculating data generator 58 as a timing signal ABCT2, whereas its second stage output is applied to the subordinate tone calculating data generator 58 as a timing signal ABCT3. The third stage output of the shift register 57 is applied to the set input S of the flip-flop circuit 54.

In response to these timing signals ABC1, ABC2 and ABC3, the subordinate tone calculating data generator 58 produces calculating data corresponding to three types of the subordinate tones. To the subordinate tone calculating data generator 54 are applied major signal Maj, minor signal min. and seventh signal 7th from the mode switch circuit 13 (FIG. 1), which represent the type of the chord thereby determining the interval of the subordinate tone according to the type of the chord. While the major signal Maj is being applied, the subordinate tone calculating data generator 58 generates a calculating data CD for the first note interval (that is the root tone) in response to the timing signal ABCT1, a calculating data CD for the third note interval in response to the timing signal ABCT2 and a calculating data CD for the fifth note interval in response to the timing signal CT3. While the minor signal min is given, the calculating signal CD generated in response to the timing signal ABCT2 is changed into a data of the minor third note interval. When the seventh signal 7th is given, the calculating data CD generated in response to the timing signal ABCT3 is changed into a data of a minor seventh note interval. The subordinate tone calculating data CD generated by the subordinate tone calculating data generator 58 is inputted to the B input of the computating circuit 50.

Generally, the computating circuit 50 is designed to add together A input and B input to obtain a key code for the subordinate tone. Accordingly the values of the subordinate calculating data are: 0 for the first interval, 4 for the minor third interval, 5 for the major third interval, 9 for the perfect fifth interval and 13 for the minor seventh interval. As can be noted from Table I, when above illustrated values 0–13 are respectively added to the C note code "0001", for example, note codes of predetermined interval relation can be obtained. As shown in Table I, in the note code NCD, four data of "0100", "1000", "1100" and "0000" do not correspond to any note. Accordingly, in order to prevent the computating circuit or adder 50 from forming data not corresponding to any one of the chords, a suitable correction value is added to the resulting sum. More particularly, the computation circuit 50 includes a correction data read only memory device ROM so that a correction data is read out from the ROM in accordance with the sum of A and B inputs and the correction data thus read out is added to the sum to obtain a correct key code for the subordinate tone.

The key code of the subordinate tone outputted from the computating circuit 50 is applied to a gate circuit 51 and to the enabling input EN thereof is applied the output of the AND gate circuit 59. The single finger function slection signal SF, and timing signals ABCT1–ABCT3 are applied to an AND gate circuit 59 via an OR gate circuit 60. For this reason, when three key codes constituting a chord according to timing signals ABCT1 through ABCT3 is automatically formed by the computating circuit 50 the gate circuit 51 is enabled so that these three key codes are supplied to the channel processor 24 through the OR gate circuit group 48. When all automatically formed three key codes have been supplied to the channel processor 24 an output "1" is produced from the third stage of the shift register 57 to clear the content of the latch circuit 46 and to set the flip-flop circuit 54. When the tone production channel utilization mode is at the common mode, the key range signal generator 52 (or the key group signal generator) produces a high range signal YUK in synchronism with the key code KC (i.e., KC) arriving at the channel processor 24 via the gate circuit 44 and the OR gate circuit group 48 regardless of the key range to which these key codes belong. In the case of the split mode, a high key range signal YUK is generated corresponding to a high key range detection signal UPD and a low key range YLK is generated corresponding to a low key range detection signal or the enabling time of the gate circuit. More particularly, a high key range detection signal UPD or a low key range detection signal LPD produced by the key range detection circuit 45 is inputted to one input of an AND gate circuit 62 through an OR gate circuit 61, while the common mode signal $\overline{\text{SPL}}$ is inputted to the other input of the AND gate circuit 62. Accordingly, under the common mode, when a certain key code KC is applied to the channel processor 24 via the gate circuit 44 and the OR gate circuit group 48 to act as a key code KC*, the output of the AND gate circuit 62 becomes "1" so that a high key range signal YUK can be obtained through an OR gate circuit 63. The high key range detection signal UPK is inputted to one input of an AND gate circuit 64, while a split mode signal SPL is inputted to the other input of this AND gate circuit 64. Consequently, in the case of the split mode SPL, when a key code KC(KC*) of the high key range (the third and the fourth octaves) is applied to the channel processor 24 the output of the AND gate circuit 64 becomes "1" so that a high key range signal YUK can be obtained through an OR gate circuit 63.

The low key range detection signal LPD and the finger code detection function selection signal FC are inputted to an AND gate circuit 65, so that under the finger code function (FC) when the key code KC (KC*) of the low key range (the first and the second octaves) is applied to the channel processor 40 the AND gate circuit 65 produces a low key range signal YLK via an OR gate circuit 66. In the case of the single finger function SF, the output of the AND gate circuit 59 is applied to one input of an OR gate circuit so that when the three key codes KC* constituting a chord are applied to the channel processor 24 from the gate circuit 51 via the OR gate circuit group 48 the OR gate circuit 66 produces a low key range signal YLK.

Figure 5:
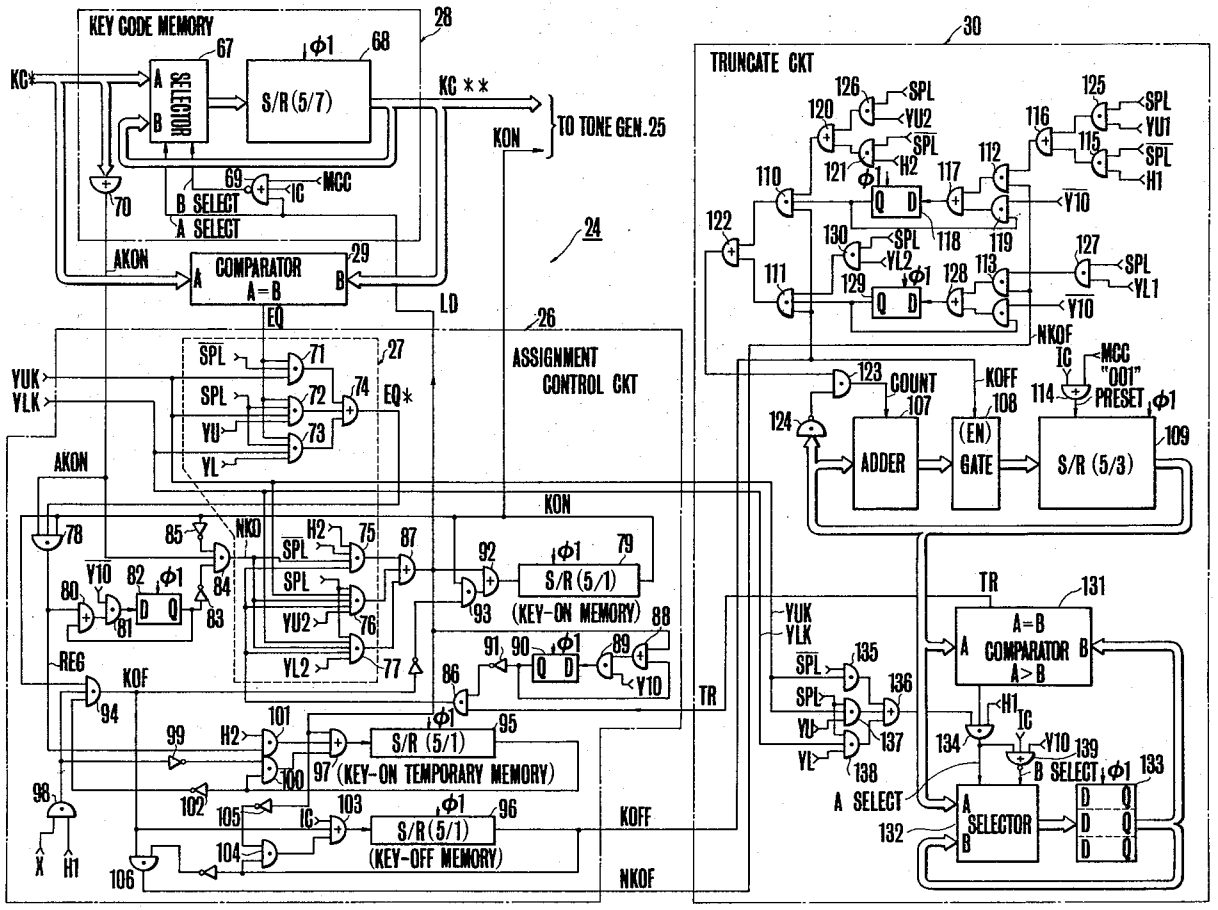
FIG. 5 is a block diagram showing one example of the channel processor shown in FIG. 1

One example of the channel processor 24 is shown in FIG. 5. Although the timing signal generator 31 contained in the channel processor 24 is not shown in FIG. 6, this timing signal generator 31 (see FIG. 1) produces various control signals H1, H2, YU, YL, YU1, YL1, YU2, YL2 and $\overline{Y10}$ shown in FIG. 3 in accordance with the synchronizing pulse SY supplied from the key code 12 (FIG. 2) and the clock pulse $\phi 1$. The channel processor 24 performs one assignment processing during an interval of 10 microseconds in which one key code KC* is supplied. In this one assignment process cycle are included two sets of the time division time slots 1 to 5 of the tone production channels ch1 to ch5 (see FIG. 3). As shown in FIG. 3, the signal H1 is generated corresponding to the fore half five time slots of one assignment processing cycle, while the signal H2 is generated corresponding to the later half five time slots. A key range channel group timing signal YU corresponding to channels ch1 and ch2 is generated corresponding to time division channel time slots 1 and 2, while a low key range channel group timing signal YL corresponding to channels ch3 to ch5 is produced corresponding to the time division channel time slots 3, 4 and 5. The signal YU1 is generated corresponding to the time slots 1 and 2 in the fore half five time slot H1, while the signal YU2 is generated corresponding to the time slots 1 and 2 in the later half five time slots H2. The signal YL1 is generated corresponding to the time slots 3, 4 and 5 in the fore half five time slots H1 whereas the signal YL2 is generated corresponding to the time slots 3, 4 and 5 in the later half five time slots H2. The signal $\overline{Y10}$ becomes "0" only in the last time slot in one assignment processing cycle but "1" in the other nine time slots.

In FIG. 5, a key code memory device 28 comprises a selector 67 and a 5 stage 7 bit shift register 65 and the key codes (7 bit data consisting of a note code NCD and an octave code OCD) assigned to respective channels ch1 to ch5 are stored in respective stages of the shift register 68. An assigned key code KC outputted from the last stage of the shift register 68 is returned to the first stage thereof via the B input of the selector 67**, to the A input thereof being applied with a key code KC* having a width of 10 microseconds supplied from the OR gate circuit group 45 of the key range detecting and subordinate tone forming circuit 23. When supplied with a load signal LD from the assignment control circuit 26, the selector 67 selects a key code KC* applied to its A input and applies it to the shift register 68 but blocks B input. Thus when the load signal LD is "1", the output of a NOR gate circuit 69 becomes "0" thus preventing the selection of the B input. When a source switch, not shown, is closed the initial clear signal temporary becomes "1" thus blocking B input even when the output of the NOR gate circuit 69 becomes "0". Even when the tone production channel utilization mode is switched, the output of the NOR gate circuit 69 is maintained at "0" for an interval of 10 microseconds by the mode switching clear signal MCC so that the B input of the selector 67 is blocked to clear all memories regarding the five stages of the shift register 68. Normally the inputs (LD, MCC, IC) to the NOR gate circuit 69 are all "0" so that the selector 67 selects its B input and the memories of the shift register 68 would be held. This shift register is driven by the clock pulse $\phi 1$ having a period of 1 microsecond.

The key code KC* having a width of 10 microseconds and supplied from the key range detecting and subordinate tone forming circuit 23 (FIG. 4) is applied to an OR gate circuit 70 and the A input of a comparator 29. Where a certain key code KC* to be subjected to the tone producing assignment processing is being supplied to the channel processor 24, the output of the OR gate circuit 70 becomes "1" and is supplied to the assignment control circuit 26 to act as an any key-on signal AKON. To the B input of the comparator 29 is applied a key code KC outputted, on the time division basis, at an interval of 1 s from the shift register 68 and has already been assigned to respective channels ch1 to ch5. When A=B, the comparator 29** produces a coincidence detection signal EQ. An equation A=B means that the key code KC* to be subjected to the assignment processing has already been stored in the key code memory device 28.

Portions of the assignment control circuit 26 corresponding to the assignment mode changing circuit 27 are bounded by dotted lines. The output signal EQ of the comparator 29 is inputted to one inputs of AND gate circuits 71, 72 and 73 which are provided for the purpose of judging whether the coincidence detection signal EQ has been generated or not in accordance with the channel groups to be used, the reference of the judgment varying depending upon whether the tone production channel utilization mode is the split mode SPL or the common mode $\overline{SPL}$. A common mode signal SPL and a high key range signal YUK from the key range signal generator 52 (FIG. 5) are inputted to the other inputs of the AND gate circuit 71. As above described, the high key range signal YUK is generated regardless of the key range. Any signal defining a channel to be used is not applied to the AND gate circuit 71. As a consequence, where the common mode is selected (i.e., $\overline{SPL}$ is "1") regardless of the fact that the key code KC* to be assigned belongs to which key range, and regardless of the fact that the coincidence detection signal EQ has been generated corresponding to which one of the five channels ch1 to ch5, all coincidence detection signals EQ pass through the AND gate circuit 71 to reach an OR gate circuit 74. Thus, by the operation of the AND gate circuit 71 (more particularly, by the aid of an AND gate circuit 75 to be described later) all tone production channels ch1 to ch5 brought to a state capable of being utilized by all keys of the keyboard.

The AND gate circuit 72 is inputted with a split mode signal SPL, a high key range channel group timing signal YU (see FIG. 3) and a high key range signal YUK from the key range signal generator (FIG. 4). As above described at the time of the split mode SPL a high key range signal YUK is generated according to a key code KC* of the high key range (the third and fourth octaves). The channel group to be utilized is limited to the channels ch1 and ch2 by the signal YUK. Consequently, in the case of the split mode SPL, only a coincidence signal EQ generated in accordance with the channels ch1 or ch2 is selected by the AND gate circuit, provided that the key code KC* to be assigned belongs to the high key range (to be produced with a melody tone color). Thus by the operation of the AND gate circuit 72, (more particularly, with the aid of an AND gate circuit 76 to be described later) a specific channel group (ch1 and ch2) is brought to a state that can be used by the keys (those to produce tones with a melody tone color) in the high key range.

An AND gate circuit 73 is inputted with a split mode signal SPL, a low key range channel group timing signal YL (see FIG. 3) and a low key range signal YLK from the key range signal generator (FIG. 4). As above described, at the time of the split mode SPL, and a low key range signal YLK is generated in accordance with three key codes KC* (i.e., those to be produced with an accompaniment tone color) which are automatically formed according to the key code KC* of the low key range (the first and second octaves) or the key code KC of the low key range and constitute a chord.

The channel group that can be utilized is limited to the channels ch3, ch4 and ch5 by the signal YL. Thus, in the case of the split mode SPL, only the coincidence detection signal EQ produced corresponding to the channels ch3 and ch4 is selected by the AND gate circuit 73, provided that the key code KC* to be assigned belongs to the low key range (to be produced with an accompaniment tone color) and the selected signal EQ is applied to the OR gate circuit 74. In this manner, by the operation of the AND gate circuit 73 (more particularly with the aid of an AND gate circuit 77 to be described later) the remaining tone production channel group ch3 to ch5 is utilized by a tone to be produced with an accompaniment tone color.

The outputs of the AND gate circuits 71 to 73 are applied to an AND gate circuit 78 via an OR gate circuit 74 to act as a coincidence signal EQ*. Generation of this signal EQ* means that a key code KC* to be assigned has already been assigned to one channel of the channel group that can be utilized by the key code KC*. To the inputs of the AND gate circuit 78 are applied an any key-on signal AKON from the OR gate circuit 70 and a key-on signal KON from a shift register 79 that functions as a key-on memory device. When the AND gate circuit 78 is enabled in a time slot of a certain channel, it means that a key code KC* to be assigned is now being supplied to the channel processor 24 (AKON="1"), that its key code KC* has already been assigned to that channel (EQ*="1"), and that a key is now being depressed (KON="1"). The output of the AND gate circuit 78 is utilized as a registered signal REG. Where this signal is generated, the assignment control signal generator 26 does not produce any load signal LD but generates a load signal only when the registered signal REG is not produced. The comparison of the key code KC* and the key code KC** all channels ch1 to ch5 made by the comparator 29 completes in the fore half 5 microseconds (the interval of generating signal H1) of the assignment processing cycle. Accordingly, where the registered signal REG is generated in the fore half H1 of one cycle, any load signal LD would not be generated.

The output REG of the AND gate circuit 78 is applied to a delay flip-flop circuit 82 through an OR gate circuit 80 and an AND gate circuit 81. The output of the delay flip-flop circuit is fed back to its input through the OR gate circuit 80 and the AND gate circuit 81 and when a signal Y10 (see FIG. 3) applied to the other input of the AND gate circuit 81 becomes "0", the content of the delay flip-flop circuit 82 is cleared. Thus, when a registered signal REG is produced once, "1" is stored in the delay flip-flop circuit 82 until one cycle of the assignment processing completes to disable the AND gate circuits 84, 75, 76 and 77 via an inverter 83, thus generating no load signal LD.

On the other hand, when the key code KC* now being supplied has not yet been assigned, and registered signal REG would not be produced and the output of the inverter 83 is "1" thus enabling the AND gate circuit 84, the other input thereof being supplied with an any key-on signal AKON and a signal inverted by an inverter 85. The inverted signal of the key-on signal KON means that a key is not depressed, that is a channel not assigned with a (key code) or an already released key which has been assigned before (for the sake of description, in the following these channels are termed assignable channels). The AND gate circuit 84 produces a new key-on signal according to an assignable channel time slot, the new key-on signal showing that a key code KC* now being supplied should be assigned to either one of the tone production channels.

The new key-on signal NKON is applied to one input of each of the AND gate circuits 75, 76 and 77 in the assignment mode changing circuit 27. To the other inputs of the AND gate circuits 75, 76 and 77 is applied the common mode signal $\overline{SPL}$ or the split mode signal SPL in the same manner as the above described AND gate circuits 71, 72 and 73 so that a predetermined one of the AND gate circuits 75 to 77 is enabled by the tone production channel utilization mode ($\overline{SPL}$ or SPL). More particularly, the common mode signal $\overline{SPL}$ is applied to the AND gate circuit 75 but any signal defining a channel to be used is not applied. The AND gate circuit 76 is supplied with a split mode signal SPL and a signal YU2 (see FIG. 3) representing the later half high key range channel group timing. The AND gate circuit 77 is supplied with a split mode signal SPL and a signal YL2 representing a later half low key range channel group timing. Signals YU2 and YL2 corresponding to the later half H2 of one assignment processing are used for the purpose of enabling the AND gate circuit 76 and 77 only during the later half H2 because as a result of comparison made in the fore half H2 a correct new key-on signal NKO can be obtained in the later half H2. For the same reason, signal H2 shown in FIG. 3 is inputted to the AND gate circuit 75.

Further, the AND gate circuit 76 is supplied with a high key range signal YUK so that this AND gate circuit is enabled only when the key code KC* to be assigned is in the high key range. Further, a low key range signal YLK is applied to the AND gate circuit 77 so that it is enabled only when the key code KC* to be assigned is in the low key range. To the remaining inputs of AND gate circuits 75, 76 and 77 is applied a truncate channel designation signal TR via an AND gate circuit 86. The truncate signal designation signal TR is produced by the truncate circuit 30 in accordance with a time slot, to which a firstly released key (key code) has been assigned, of the channel group (ch1 to ch5 or ch1 and ch2 or che to ch5) to be assigned with the key code KC*. That one of the AND gate circuit 75 to 77 which is enabled by the tone producing channel utilization mode (SPL or $\overline{SPL}$) produces a signal "1" by the timing action of the truncate channel designation signal TR, so that a load signal LD is generated through an OR gate circuit 87. This load signal LD is stored in a delay flip-flop circuit 90 via an OR gate circuit 88 and an AND gate circuit 89. The content of the delay flip-flop circuit 90 is cleared at the end of the assignment processing cycle Y10. An AND gate circuit 86 is disabled by an output "1" of the delay flip-flop circuit 90 via an inverter 91 so as to prevent the truncate channel designation signal TR from being applied to the AND gate circuits 75 to 77. For this reason, the load signal LD for one channel is produced only once during one assignment processing cycle.

A new key code KC* is stored (or assigned) in the shift register 68 of the key code memory device 28 corresponding to a channel generating the load signal LD to clear or truncate the memory of an old key code KC* for that channel. Further, the load signal LD is applied to the shift register 79 via an OR gate circuit 92 to store a key-on signal K in accordance with a channel newly assigned with the key code KC*.

With the construction described above, at the time of the common mode $\overline{SPL}$, by the operation of the AND gate circuits 71 and 75, all depressed keys are assigned to either one or more of all channels ch1 to ch5. At the time of the split mode SPL, where a key in the high key range is depressed the AND gate circuits 72 and 76 operate to assign the depressed key to either one the channels ch1 and ch2, whereas when a key in a low key range is depressed (or in the case of an automatically formed chord tone) the AND gate circuits 73 and 77 operate assign tone generation to either one of the remaining channels ch3 to ch5. Furthermore for the purpose of generating a truncate designation signal TR corresponding to an adequate channel group according to a tone production channel utilization mode (SPL or SPL), as will be described later, the truncate circuit 30 produces a truncate channel designation signal TR by taking into consideration the mode signal SPL or SPL.

The memory or content of the shift register 79 acting as a key-on memory device is held through AND gate circuit 93, but cleared when the AND gate circuit 94 produces a key-off detection signal KOF. Each of the shift register 79, a shift register 95 acting as a key-on temporary register, and a shift register 96 acting as a key-off memory device has a 5 stage one bit construction and driven by the clock pulse $\phi$1 having a period of 1 microsecond in synchronism with the shift register 68 of the key code memory device 28.

The load signal LD is stored in the shift register 95 via an OR gate circuit 97, and the memory of the shift register 95 is cleared each time a key-off examination signal X is generated. More particularly, an AND gate circuit 98 is inputted with the key-off examination signal X and signal H1 and when this AND gate circuit produces a signal "1" in the fore half 5 s of an interval of 10 microseconds in which the key-off examination signal X is generated, the self holding circuit of the shift register 95 through an inverter 99 and an AND gate circuit 100 is interrupted and the memories of all five stages of the shift register 95 would be cleared. Thereafter, prior to the generation of the next key-off examination signal X, application of a key code KC* which is the same as the key code KC already assigned to a certain channel to the channel processor 24, causes the AND gate circuit 78 corresponding to that channel to produce an output REG of "1" which is stored in the shift register 95 via an AND gate circuit 101 and an OR gate circuit 97. This means that a key corresponding to this key code KC is now being depressed. However, with regard to a key code KC of a released key, since the same key code is not given, the memory of the shift register 95 corresponding to a channel to which the key code KC has been assigned remains cleared. In this case, the output of the shift register 95 corresponding to the released key channel is "0" when the next key-off examination signal X is generated, so that the output of an inverter 102 becomes "1", thus enabling the AND gate circuit. The key-on signal KON from the shift register 79 and the output of the AND gate circuit 98 are applied to the other inputs of the AND gate circuit 94 so that it produces a key-off examination signal KOF provided that as if a key-on signal is generated (KON="1") regardless of the fact that the actual state is key-off (the output of the inverter 102** is "1") at the time of generation of the key-off examination signal X.

This key-off detection signal KOF is applied to a shift register 96 and held therein through an AND gate circuit 104 and the OR gate circuit. The content of the shift register 96 is cleared when the AND gate circuit 104 is disabled by the output "0" of an inverter 105 which is caused by the generation of the load signal LD. When the AND gate circuit 94 generates a key-off detection signal KOF for a given channel, the AND gate circuit 106 produces a new key-off signal NKOF so long as the key-off signal corresponding to that channel had been "0" immediately prior to the generation of the key-off signal.

In the truncate circuit 30, the key-off signal supplied from the shift register 96 is applied to the enabling input EN of a gate circuit 108 and one inputs of AND gate circuits 110 and 111, whereas the new key-off signal NKOF is supplied to one inputs of AND gate circuits 112 and 113. A modulo 8 counter constituted by a 3 bit adder 107, the gate circuit 108 and a 5 stage 3 bit shift register 109 is provided for counting, on the time division basis, the number of times of the other keys for respective channels which are released after release of the keys assigned to respective channels. This means that a key assigned to a channel exihibiting a maximum value in the shift register 109 corresponds to a key firstly released.

An initial clear signal IC or a mode switching signal MCC is applied to the preset input of the shift register 109 via an OR gate circuit 114 with the result that at the time of closing the power source switch or at the time of switching the mode, a minimum value "001" would be preset in all stages (corresponding to all channels) of the shift register 109.

The counting of the number of key releases is controlled for each channel group (ch1 to ch5 or ch1 and ch2 or ch3 to ch5) to be used. At first in the case of the common mode $\overline{SPL}$, the output of an AND gate circuit 115 inputted with signals $\overline{SPL}$ and H1 is applied to one input of an AND gate circuit 112 via an OR gate circuit 112 so as to enable the same for the fore half interval of 5 microseconds (the interval of H1 shown in FIG. 3) of one assignment cycle. Accordingly, the AND gate circuit 112 selects a new key-off signal NKOF regarding all channels ch1 to ch5 and the signal NKOF is stored in a delay flip-flop circuit 118 via an OR gate circuit 117. The content of this delay flip-flop circuit 118 is circulated and held through an AND gate circuit 119 and the OR gate circuit 117 and then cleared by a signal $\overline{Y10}$ at the end of one cycle. The output of the delay flip-flop circuit 118 is applied to one input of the AND gate circuit 110, the other inputs thereof being connected to receive the key-off signal KOFF and the output of an OR gate circuit 120. The output of an AND gate circuit 121 inputted with signals $\overline{SPL}$ and H2 is applied to ne input of an OR gate circuit 120.

Consequently, in the case of the common mode ($\overline{SPL}$), the output "1" of the delay flip-flop circuit 118 represents that a key assgined to either one of channels ch1 to ch5 has been newly released. In this case, the AND gate circuit 110 produces an output "1" corresponding to a channel in which the key has already been released (KOFF="1") in the later half H2 of one cycle. This output "1" of AND gate circuit 118 is applied to the least significant order of an adder 107 via an OR gate circuit 122 and an AND gate circuit 123. Consequently, each time a key is newly released, the count for already released channel is incremented by one. To the other input of the AND gate circuit 123 is applied the output of a NAND gate circuit 124 which is inputted with the 3 bit output of the shift register 109 so that upon reaching a maximum value, the AND gate circuit 123 is disabled to stop the counting operation. Since the gate circuit 108 is enabled by the key-off signal KOFF, the gate 108 is disabled corresponding to a channel to which a depressed key is assigned with the result that the output of the shift register corresponding to a channel to which a depressed key has been assigned is always cleared to become "0".

In the case of the split mode SPL, the count control regarding the high key range channels ch1 and ch2 is performed by the output of the AND gate circuit 110 whereas the count control regarding the low key range channels ch3 to ch5 is performed by the output of the AND gate circuit 111. A split mode signal SPL and a signal YU1 (FIG. 3) corresponding to the channels ch1 and ch2 in the fore half of one assignment processing cycle are applied to an AND gate circuit 125 and the output thereof is applied to one input of an AND gate circuit 112 via an OR gate circuit 116. Accordingly, when a key assigned to channel ch1 or ch2 is released, a signal "1" is stored in the delay flip-flop circuit 118. A split mode signal SPL and a signal corresponding to the time slots of the channels, ch1 and ch2 in the later half of one assignment processing cycle are applied to an AND gate circuit 126 and the output thereof is applied to one input of the AND gate circuit 110 via an OR gate circuit 120. Consequently, in the case of the split mode SPL, each time a key in the high key range (the third and fourth octaves) is newly released, the count is incremented by one corresponding to either one of the high key range channels ch1 and ch2 to which a released key has already been assigned.

A split mode signal SPL and a signal YL1 (see FIG. 3) corresponding to the time slots of the channels ch3 to ch5 in the fore half of one assignment processing cycle are applied to an AND gate circuit 127 and the output thereof is applied to one input of an AND gate circuit 113. The output of the AND gate circuit 113 is applied to a delay flip-flop circuit 129 via an OR gate circuit 128, and the output of the delay flip-flop circuit 129 is applied to one input of the AND gate circuit 111. A split mode signal SPL and a signal YL2 corresponding to the time slots of the later half channels ch3 to ch5 of one assignment processing cycle are applied to an AND gate circuit 130 and the output thereof is applied to one input of the AND gate circuit 111. The output thereof is applied to adder 107 through an OR gate circuit 122, and an AND gate circuit 123. Consequently, in the same manner as above described, in the case of the split mode SPL, each time a key in the low key range (the first and the second octaves) the counts are respectively incremented by one corresponding to either one or more of the low key range channels ch3 to ch5 to which the released key has already been assigned.

The count produced by the shift register 109 and showing the number of key releases is applied to the A inputs of the comparator 131 and the selector 132. A group of three shift registors 133 stores the maximum value among the counts showing the 3 bit number of key releases produced by the shift register 109, and the output of this shift register group 133 is self-held through the B input of a selector 132 and is also applied to the B input of a comparator 131. When the maximum value is stored in the delay flip-flop group 133 the counts for respective channels outputted from the shift register 109 coincides with each other (A=B), so that the comparator 131 produces a truncate designation signal TR corresponding to the coincided channels. When the output count of the shift register 109 is larger than the value stored in the shift register group 133 (A>B) the comparator 131 sends a signal "1" to one input of an AND gate circuit 134 thus applying an A input selection signal to the selector 132 via the AND gate circuit 134 to store the output count of the shift register 109 in the delay flip-flop circuit group 133.

The AND gate circuit 134 selects only the result of comparison (A>B) regarding a given channel group in accordance with the channel utilization mode SPL or $\overline{SPL}$ during the fore half interval of generating signal H1 of one assignment processing. At the time of the common mode, the AND gate circuit 135 is enabled by the common mode signal $\overline{SPL}$. To the other input of the AND gate circuit 135 is applied a high key range signal YUK so that when a certain key code KC* is supplied to the channel processor 24, the AND gate circuit 135 produces an output "1" which is applied to one input of an AND gate circuit 134 through an OR gte circuit 136. Consequently, in the case of the common mode $\overline{SPL}$ the results of comparison (A>B) regarding all channels ch1 or ch5 are selected by the AND gate circuit 134.

At the time of the split mode, AND gate circuits 137 and 138 enabled by the split mode signal SPL. Since a high key range signal YUK and a high key range channel group timing signal YU are applied to the other inputs of the AND gate circuit 137, when a high key range key code KC* is supplied to the channel processor 24 the output of the AND gate circuit 137 becomes "1" corresponding to the time slots (see FIG. 3) of the channels ch1 and ch2 and this output "1" is applied to the AND gate circuit 134 via the OR gate circuit 136. As a consequence, at the time of the split mode when the key code KC* belongs to the high key range the result of comparison (A B) regarding the channels ch1 and ch2 is selected by the AND gate circuit 134. To the other inputs of the AND gate circuit 138 are applied a low key range signal YLK and a low key range channel group timing signal YL so that when the key code KC* belongs to the low key range at the time of the split mode the results of comparison (A>B) regarding channels ch3, ch4 and ch5 are selected by the AND gate circuit 134.

When the AND gate circuit 134 produces an A input selection signal, the output of the NOR gate circuit 139 becomes "0" thus blocking the B input of the selector 132. As a consequence, an old memory of the delay flip-flop group 133 is cleared and the count of the shift register 109 would be stored in the delay flip-flop group 133 as a new maximum value. Further, as a signal Y10 obtained by inverting signal Y10 is applied to the NOR gate circuit 139 the output of the NOR gate circuit 139 becomes zero at the end of one assigning processing cycle, thus clearing the memory of the delay flip-flop circuit group 133.

The result of comparison (A>B) of the comparator 131 is stored in the delay flip-flop circuit group 138 in the fore half (the interval of generating signal H1) of one processing cycle. Accordingly, it is sure that in the later half of one processing cycle (the interval of generating signal H2) a true maximum count is stored in the delay flip-flop group 138. For this reason, the comparator 131 produces a correct truncate channel designation signal TR.

Figure 6:
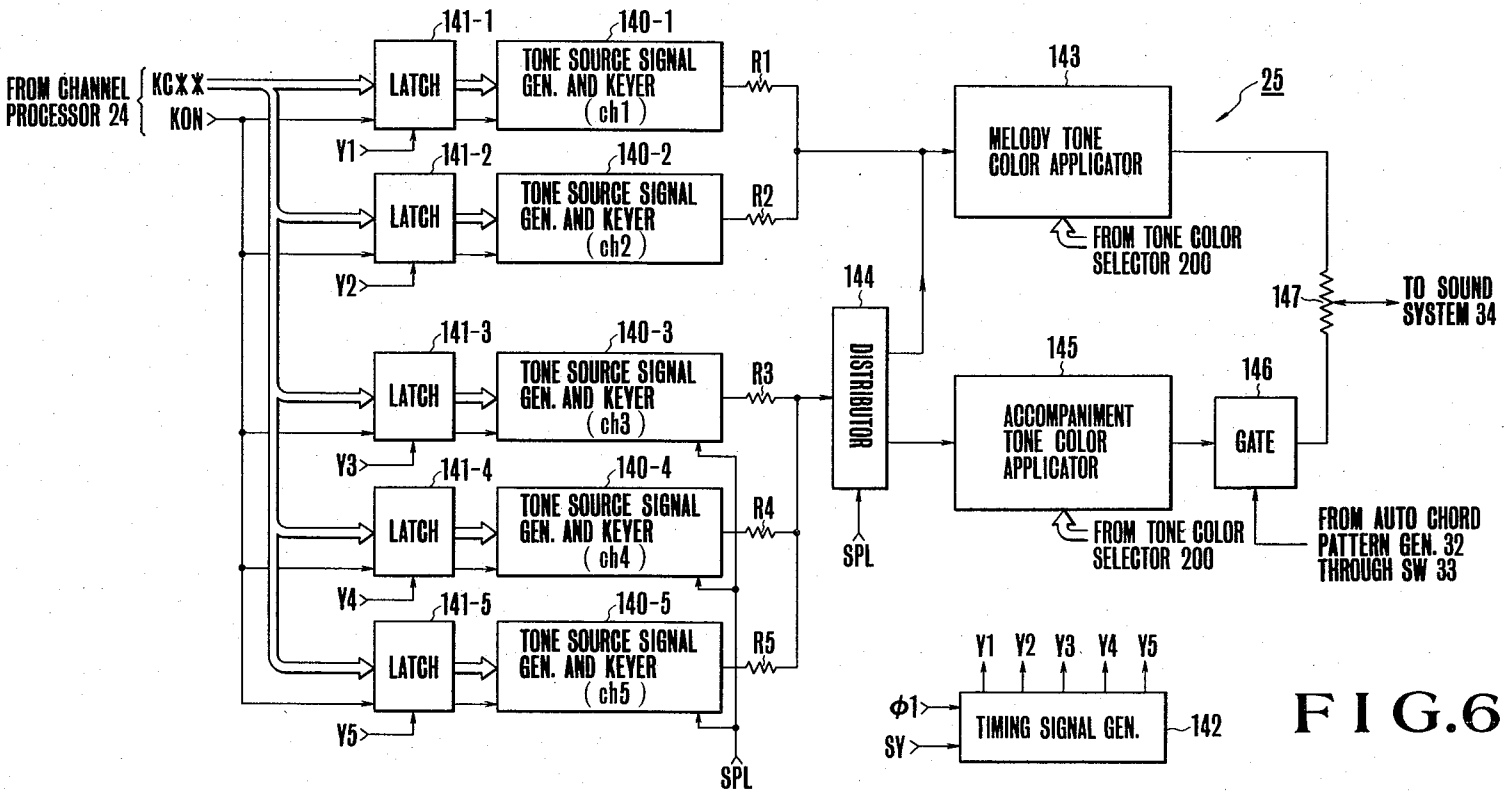
FIG. 6 is a block diagram showing one example of the tone generator shown in FIG. 1.

The tone generator 25 shown in FIG. 6 comprises tone source generator 140-1 through 140-5) respectively corresponding to the tone production channels ch1 through ch5. The key code KC and the key-on signal KON supplied from the key code memory device 28 and the shift register 79 shown in FIG. 5 and acting as a key-on memory device are applied to latch circuits 141-1 through 141-5 corresponding to respective channels, and signals Y1 to Y5 are used as the strobe pulses of the latch circuits 141-1 through 141-5. These signals are generated by the timing signal generator 142 corresponding to the time division time slots of respective channels ch1 to ch5 as shown in FIG. 3. Consequently, the latch circuits 141-1 through 141-5 respectively latch the key code signal KC and the key-on signal KON assigned to respective channels.

The key code KC and the key-on signal KON latched by respective latch circuits 141-1 through 141-5 are applied to the tone source signal generators 140-1 and 140-5 which produce tone source signals corresponding to the key code KC supplied from the latch circuits 141-1 through 141-5 according to the key-on signal KON. A split mode signal SPL is applied to the tone source signal generator 140-3 through 140-5 corresponding to the channels ch3 through ch5 so as to change the waveform and the amplitude envelope of the tone source signals produced by the tone source signal generator 140-3 through 140-5.

The tone source signals produces by the tone source generator 140-1 and 140-2 for the channels ch1 and ch2 are mixed together by resistors R1 and R2 and then applied to a melody tone color circuit 143, whereas the tone source signals produced by the tone source signal generators 140-3 through 140-5 for the channels ch3, ch4 and ch5 are mixed together by resistors R3, R4 and R5 and then applied to a distributor 144. This distributor supplies to a melody tone color circuit 143 the tone source signals for the channels ch3 to ch5 supplied thereto when the split mode signal SPL is "0" that is at the time of the common mode $\overline{\text{SPL}}$, whereas supplies to an accompaniment tone color circuit 145 for the channels ch3 to ch5 applied at the time when the signal SPL is "1" that is at the split mode. Thus, in the case of the common mode $\overline{\text{SPL}}$, the tone signals for all channels ch1 through ch5 are applied to the melody tone color circuit 143 to be imparted with a melody tone color. On the contrary, in the case of the split mode SPL, the tone source signals for the channels ch1 and ch2 assigned with the high key range keys, i.e., the melody performance key range are applied to the melody tone color circuit 143 to be imparted with a melody tone color, while the tone source signals of the channels ch3 to ch5 with low key range keys, i.e., the accompaniment performance key range are applied to the accompaniment tone color circuit 145 to the imparted with an accompaniment color. The term "melody tone color or accompaniment tone color" does not designate a specific tone color but means any tone color selected by the performer for a melody tone color or an accompaniment tone color by operating an operating member of a panel, that is the tone color selector 200 shown in FIG. 1.

The output of the accompaniment tone color circuit 145 is inputted to a gate circuit 146 for producing an analog signal. The gate circuit 146 is always enabled when the autochord selection switch is opened, so that a musical tone signal for the accompaniment tone given from the acompaniment tone color circuit 145 passes through the gate circuit as it is. When the autochord selection switch 33 is closed, the accompaniment tone signal from the accompaniment tone color circuit 145 is automatically blocked or passed through the gate circuit 146 according to a gate pulse generated by the autochord pattern generator 32 thereby automatically interrupting a chord. The melody tone signal from the melody tone color circuit 143 and an accompaniment signal from the gate circuit 146 are admixed by a balance type variable resistor 147 and then supplied to a sound system 34.

Although in the foregoing embodiment the invention was applied to an electronic musical instrument of the one stage type keyboard it should be understood that the invention is also applicable to an electronic musical instrument provided with a plurality of stages on the keyboards. Thus, the invention is applicable to any electronic musical instrument in which the same tone color or different tone colors can be produced by selectively assigning tone production channels of a limited number to two or more keyboard or key ranges. Accordingly, the performance mode is not limited to the melody performance and the accompaniment performance as in the foregoing embodiment and the provision of the autobass chord performance is not essential.

Where the present invention is applied to an electronic musical instrument provided with a upper keyboard and a lower keyboard, the high key range in the foregoing embodiment may be replaced by the upper keyboard and the lower key range may be replaced by the lower keyboard. For example, where the number of the tone production channels is 10, for the split mode SPL, specific 5 channels are used exclusively for the upper keyboard and the remaining 5 channels are used exclusively for the lower keyboard, whereas for the common mode $\overline{\text{SPL}}$, all 10 channels are used for the upper keyboard. In the case of the one stage type keyboard shown in the embodiment, for the common mode $\overline{\text{SPL}}$, the keys LPD in the low key range is switched to the high key range by the key range signal generator 52 shown in FIG. 5 to generate a high key range signal YUK (a key group signal) corresponding to all keys. However, it is not always necessary to switch the keys of the lower keyboard to the upper keyboard by applying this principle to an musical instrument provided with upper and lower keyboards, and in the case of the common mode SPL an upper keyboard signal (a key group signal corresponding to the high key range signal YUK) may be produced corresponding to the actually depressed keys of the upper keyboard.

It should also be understood that the constructions of the key coder 12, the channel processor 24 and the tone generator 25 are not limited to those shown in FIGS. 5 and 6 and that any suitable constructions may be used.

As above described, according to this invention as it is possible to change the mode of utilization of the tone production channels of a limited number according to the mode of performance, the tone production channels of a limited number can be utilized efficiently. Consequently, it is possible to decrease the cost of manufacturing by decreasing the number of the tone production channels. In other words, it is possible to assure tone production channels of a number sufficient to produce a desired tone thus removing poorness of the performance caused by the deficiency of the number of the tone production channels.

It will be clear that the invention is not limited to the specific embodiment described above and that many changes and modifications will be obvious to one skilled in he art. Fur example if desired, a mode may be prepared for assigning all tone production channels to a specific portion of the key range of the keyboard.

What is claimed is:

1. An electronic musical instrument comprising:

keyboard means provided with a plurality of keys;

musical tone generating means including a plurality of musical tone production channels of a number smaller than that of a total number of said keys;

assigning means for assigning a tone production corresponding to a depressed key of a group comprising certain keys of said plurality of keys to one of said musical tone production channels;

means for selecting a performance mode of the electronic musical instrument from among a plurality of performance modes and for dividing said musical tone production channels into a plurality of groups in accordance with the set performance mode; and assignment mode changing means for changing musical tone production channels belonging to a channel group to which the keys in said key group are assigned in accordance with an output of said performance mode selecting means;

said assigning means assigning tone production of the depressed key of said key group to one of said musical tone production channels of said channel group determined by said assignment mode changing means;

said musical tone production means acting to make different manners of tone production among respective channel groups according to the output of said performance mode selecting means.

2. An electronic musical instrument according to claim 1 wherein in one performance mode, the musical tone production channels are grouped into a large group comprising of all or most of said musical tone production channels and in another performance mode said channels are grouped into a plurality of small groups formed by dividing the musical tone production channels into said small groups, and wherein said assignment mode changing means comprises mode designating means for selectively designating a common mode or a split mode according to the performance mode and utilized channel group changing means which in said common mode enables utilization of the musical tone production channels of said large group only for assigning keys of a predetermined key group, whereas in said split mode enables utilization of the musical tone production channels of the respective small groups for assigning keys of different key groups.

3. An electronic musical instrument according to claim 2 wherein said keyboard means comprises a single stage keyboard, said predetermined key group for said common mode comprises all keys of said single stage keyboard, and said different key groups for said split mode correspond to respective key ranges formed by dividing said single stage keyboard into a plurality of key ranges.

4. An electronic musical instrument according to claim 2 wherein said keyboard means comprises an upper keyboard and a lower keyboard, said predetermined key group of said common mode comprises keys of either one of said upper and lower keyboards, and said different key groups for said split mode comprise keys of said upper and lower keyboard respectively.

5. An electronic musical instrument according to claim 2 wherein said musical tone production means comprises tone color switching means which in said common mode makes the same colors of tones produced by said musical tone production channels of said large group, whereas in said split mode makes different colors of the tones produced by said musical tone generating means for respective ones of said small group.

6. An electronic musical instrument according to claim 5 wherein said tone color switching means comprises a plurality of different tone color circuits and a distributor which applies a tone signal produced by a predetermined one of said musical tone production channels to a predetermined tone color circuit.

7. An electronic musical instrument according to claim 2 wherein said utilized channel group changing means comprises a key group signal generator which produces according to the assignment mode a key group signal representing a key group to which the depressed key belongs, and an assignment mode changing circuit which when said common mode is selected and when said key group signal represents the predetermined key group indicates that the keys of said predetermined key group can be assigned to the musical tone production channels in said large group whereas when said split mode is selected indicates that the depressed key can be assigned to a musical tone production channel in a predetermined one of said small groups of keys represented by said key group signal, whereby the depressed key is assigned to one of said musical tone production channels designated by said assignment mode changing circuit.

8. An electronic musical instrument according to claim 1 further comprising a chord pattern generator and a switch, and wherein said musical tone generating means comprises means for periodically interrupting a musical tone according to an output of said chord pattern generator when said switch is closed.

* * * * *

UNITED STATES PATENT AND TRADEMARK OFFICE

CERTIFICATE OF CORRECTION

PATENT NO. : 4,365,532

DATED : December 28, 1982

INVENTOR(S) : AKIRA NAKADA; TAKESHI ADACHI

It is certified that error appears in the above–identified patent and that said Letters Patent are hereby corrected as shown below:

Column 23, line 47, change "production" to --generating--.

Signed and Sealed this

*Twenty-sixth* Day of *April 1983*

[SEAL]

*Attest:*

GERALD J. MOSSINGHOFF

*Attesting Officer*

*Commissioner of Patents and Trademarks*